US005215438A

United States Patent [19]

Chou et al.

[11] Patent Number: 5,215,438

[45] Date of Patent: Jun. 1, 1993

[54] FAN HOUSING

[75] Inventors: Rudy S. Chou; Ronald L. Doyel, both of Liverpool, N.Y.

[73] Assignee: Carrier Corporation, Syracuse, N.Y.

[21] Appl. No.: 954,520

[22] Filed: Sep. 30, 1992

Related U.S. Application Data

[63] Continuation-in-part of Ser. No. 788,898, Nov. 7, 1991, abandoned.

[51] Int. Cl.[5] ..... F01D 25/24

[52] U.S. Cl. ..... 415/223; 415/914

[58] Field of Search ..... 415/223, 208.1, 211.2, 415/203, 206, 914

[56] References Cited

U.S. PATENT DOCUMENTS

| | | | |
|---|---|---|---|
| 3,088,695 | 5/1963 | Clark | 415/914 |
| 3,118,594 | 1/1964 | Helmbold | 415/914 |
| 3,508,517 | 4/1970 | Hannan | 415/914 |
| 3,519,367 | 7/1970 | Soulez-Lariviere | 415/914 |
| 4,181,172 | 1/1980 | Longhouse | 415/223 |
| 4,585,391 | 4/1986 | Vuillet et al. | 415/914 |
| 4,927,328 | 5/1990 | Scoates et al. | 415/914 |
| 5,066,194 | 11/1991 | Amr et al. | 415/914 |

*Primary Examiner*—John T. Kwon

[57] ABSTRACT

A housing for a propeller or axial flow fan. The housing comprises an orifice portion, a stator element portion and a motor mount portion, preferably made in a single piece by casting in metal. The single piece construction makes possible the positioning of the axis of rotation of the fan to be used with the housing precisely coincident with the axis of the orifice and thus permits very small fan blade tip to orifice wall clearances to be attained, increasing the efficiency of the fan assembly and reducing its radiated noise. The inlet of the orifice is elliptical to promote attached flow. In a preferred embodiment, the motor mount portion of the housing also is configured to serve as the motor shaft end cap of the electric motor used to drive the fan. The number of parts in a complete fan, housing and motor unit in such a configuration is reduced to two, the fan and the motor, reducing the time required to assemble and install the unit.

6 Claims, 3 Drawing Sheets

FAN HOUSING

BACKGROUND OF THE INVENTION

This application is a continuation-in-part of application Ser. No. 07/788,898, filed 7 Nov. 1991, now abandoned.

This invention relates generally to apparatus for moving air. More particularly, the invention relates to a housing for an axial flow or propeller type fan. The housing incorporates an orifice, fan stator and support for a fan motor. The nature of its construction allows for extremely close clearances between the wall of the housing orifice and tips of the blades of the fan with which the housing is used, resulting in improved air handling performance.

Axial flow fans driven by electric motors are widely used in a variety of applications to move air. One example of such an application is in a refrigeration system, where a fan is used to move air across a heat exchanger in which heat is transferred between the air and a refrigerant. In a typical installation, the fan is directly mounted to the shaft of the motor. The motor is attached to a motor mount that is in turn fixed by a motor support or supports with respect to a fan housing so that the fan is centered in the opening in the housing through which the air to be moved passes.

It is inherent that an axial flow fan imparts to the air flowing through it not only a velocity component that is parallel to the axis of rotation of the fan but also a swirl comprised of variable velocity components of various obliquities to the fan rotational axis. Since the function of the fan is to move air in a direction parallel to its rotational axis, velocities imparted in other directions represent a degradation in efficiency.

Vortices can also form at the blade tips, further degrading efficiency. And whether the motor support or supports are upstream or downstream of the fan, they can impart an energy degrading disturbance to the air flow. For a required air flow, efficiency degradations result in increased power consumption and radiated noise.

Prior art designs have reflected recognition that an appropriately configured stator installed in conjunction with the fan will redirect the swirl components of air velocity into a direction that is more nearly parallel to the fan rotational axis, thus recovering some of the energy that would otherwise be lost as swirl.

Prior art designs have also reflected recognition that blade tip vortex formation can be reduced by reducing the clearance between the tips of the fan blades and the fan housing. Prior art designers have been limited in their ability to take advantage of tip clearance reduction. Prior art fan housings and motor support assemblies have usually consisted of a number of individual parts and subassemblies. Because it has been nearly impossible, in large scale manufacturing operations at reasonable cost, to fabricate and install a fan and fan housing in which the centering of fan in the housing is sufficiently precise, designers have had to leave a relatively generous clearance between fan and housing to account for manufacturing and assembly tolerances. Increased numbers of parts also result in increased complexity in and time for assembling a complete fan and housing unit.

SUMMARY OF THE INVENTION

The present invention is a self-centering orificed housing for an electric motor driven axial flow fan. The housing is of one piece construction and includes fan motor supports that also function collectively as a fan stator. The construction of the housing is such that assembling the motor into the housing results in the motor shaft being precisely located at the center of the housing orifice, thus making possible a design in which there is a very small clearance between the orifice wall and the blade tips of the fan with which the housing is used.

If constructed in the preferred metal embodiment, the housing also serves as a sink that aids in dissipating the heat produced by the motor while in operation.

The inlet of the orifice, in planes passing through the axis of generation of the orifice, is elliptical in cross section. This configuration promotes attached flow in the air entering the orifice, contributing to reduced noise generation and increased efficiency in the fan and orifice system.

In a preferred embodiment, the motor mount is configured to replace and function as an end cap of the motor with which the housing is used. In that embodiment, the number of parts in a complete assembly of motor, fan motor supports, stator, housing and fan is two, the fan and the motor. This reduces the time required put the assembly together. As well, the time required to incorporate the assembly into a finished product is reduced.

BRIEF DESCRIPTION OF THE DRAWINGS

The accompanying drawings are a part of the specification. Throughout the drawings, like reference numbers identify like elements.

DESCRIPTION OF THE PREFERRED EMBODIMENTS

The fan housing of the present invention is intended for use with a fan mounted directly on the shaft of an electric motor. The typical motor used in such an application has a central casing and two end caps. Both end caps usually contain mountings for the motor bearings. The motor shaft penetrates through one of the end caps so that a load, such as a fan, may be attached to the shaft. In one embodiment of the present invention, the fan housing is configured so that it includes and takes the place of the motor end cap through which the motor shaft penetrates. In another embodiment of present invention, the fan housing is configured so that the end cap of the motor snugly slips into and is fixed within the housing.

Figure 1:
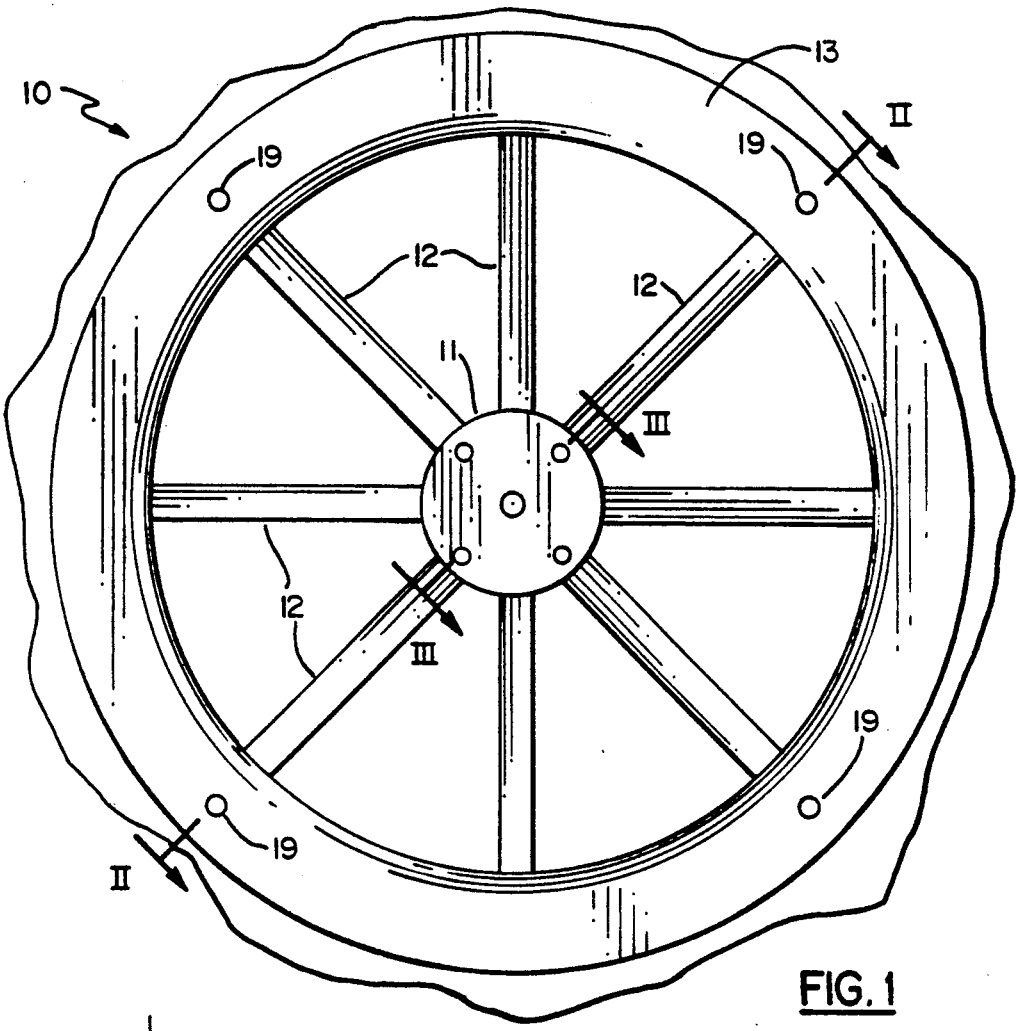
FIG. 1 is a plan view of the fan housing of the present invention.

FIG. 1 depicts in plan view fan housing 10 of the present invention. Fan housing 10 is a single piece as, for example, a metal casting. Fan housing 10 comprises orifice portion 13, stator element portions 12 and motor mount portion 11. Fan housing 10 also has mounting means 19 to allow its fixing in position relative to, for example, the heat exchanger in a refrigeration system.

Figure 2:
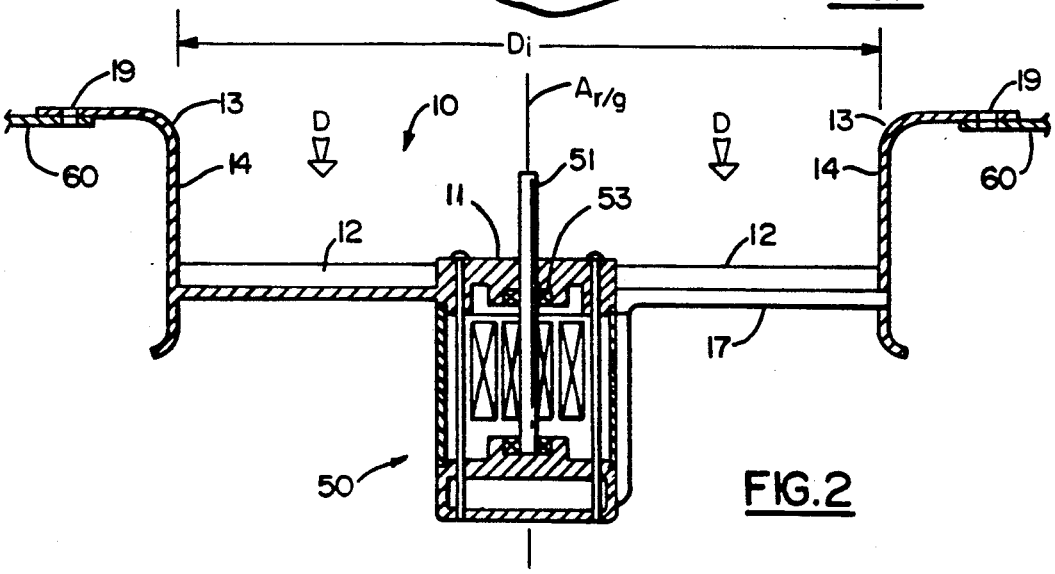
FIG. 2 is a sectioned, through line II—II in FIG. 1, elevation view of one embodiment of the fan housing of the present invention.

FIG. 2 depicts the embodiment of the fan housing of the present invention in which fan housing 10 also serves as the end cap for the motor that is used with the housing. In this embodiment, motor mount portion 11 has provisions for mounting motor bearings 53 and for the penetration of shaft 51 of motor 50 through it. To make a complete assembly of fan, housing and motor, of course, a fan (not shown) would be mounted on shaft 51.

One stator element should include conduit 17 in which to run the electrical power leads to motor 50. Fan axis of rotation $A_r$ passes through the center of shaft 51. Coincident with axis of rotation $A_r$ is axis of generation $A_g$. Air flow through housing 10 is in the direction shown by arrows D.

Figure 3:
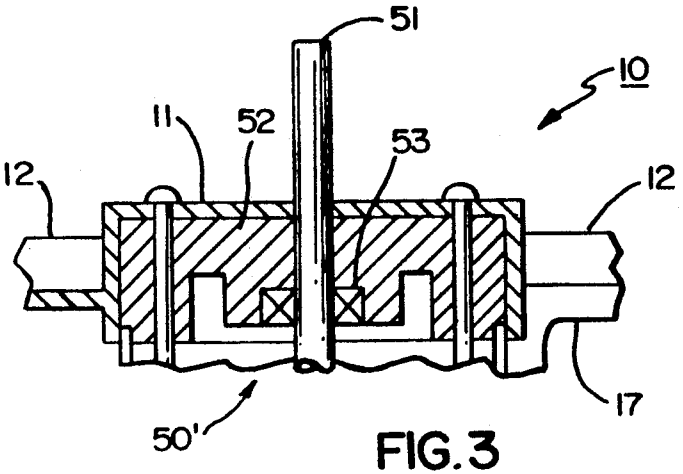
FIG. 3 is a sectioned, through line III—III in FIG. 1, elevation view of a portion of another embodiment of the fan housing of the present invention.

FIG. 3 depicts the embodiment of the fan housing of the present invention in which its associated motor is a complete unit having two end caps. In this embodiment, motor mount portion 11 of fan housing 10 is sized and configured to accept end cap 52 of motor 50'. There should be a snug, precision fit, with little or no allowance for any but axial relative movement, between motor mount portion 11 and end cap 52 so that, when assembled, the centerline of motor shaft 51 is coincident with the axis of fan housing 10.

Figure 4:
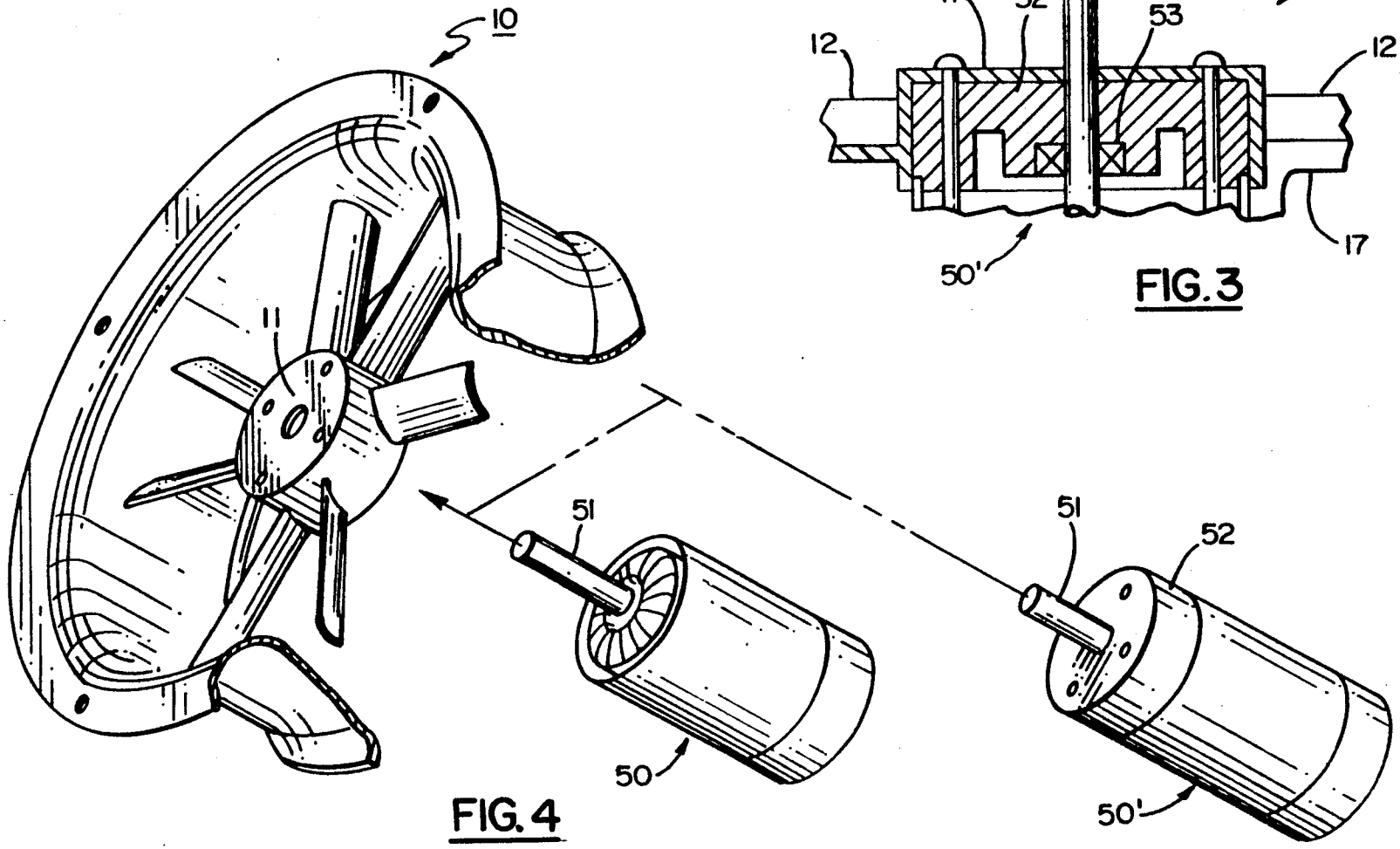
FIG. 4 is an isometric view, partially broken away, depicting, in the alternative, the two embodiments shown in FIGS. 2 and 3, together with their associated electric motors.

FIG. 4 more completely shows the two embodiments in FIGS. 2 and 3, together with their associated electric motors and illustrates that fan housing 10 can be used either where motor mount 11 serves as the shaft end bell of motor 50 or where motor 50' has end bell 52 that fits into motor mount 11.

Figure 5:
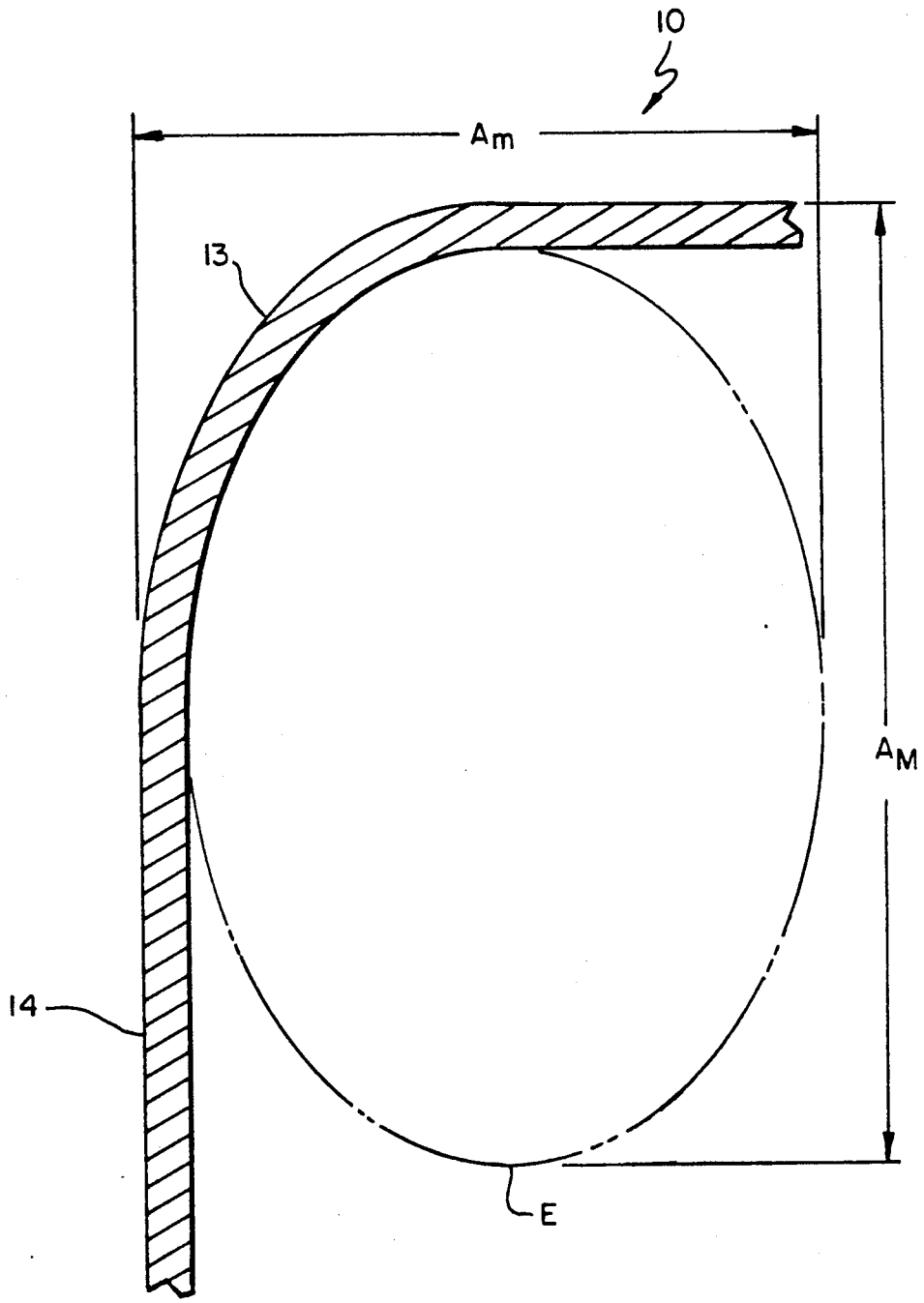
FIG. 5 is a detail view of one portion of the fan housing shown in FIG. 1.

The configuration of inner wall 14 can perhaps best be described as the surface generated by rotating a planar line about axis of generation $A_g$, which axis is coincident with fan axis of rotation $A_r$. FIG. 5 shows in detail the configuration of that portion of inner wall 14 that forms the inlet of orifice 13. In planes passing through the axis of generation of the housing, the inlet of orifice 13 is elliptical in cross section. The portion of the line that generates the inlet of orifice 13 is a quarter section of ellipse E. Ellipse E has major axis $A_M$, parallel to the axis of generation, and minor axis $A_M$. In a preferred embodiment, the length of minor axis $A_m$ should be in the range of two to 20 hundredths of $D_i$, the inner diameter of orifice 13, ($0.02D_i \leqq A_m \leqq 0.2D_i$) with an optimum value being about one tenth ($A_m = 0.1D_i$). The length of major axis $A_M$ should be about one to three times the length of minor axis $A_m$ ($A_m \leqq A_M \leqq 3A_m$), with an optimum value being about two times ($A_M = 2A_m$).

One application for the housing of the present invention is in the air management subsystem of a transport refrigeration system, where the housing and its associated fan are used to move air through the system condenser. Using usual art configurations and techniques, the motor, motor supports and orifice of the condenser air handling system are separate parts and require at least two persons to assemble and install into a finished system. The fan housing of the present invention, with its associated fan already installed on the motor shaft and precisely aligned, can be delivered to the final system assembly point as a complete unit, ready to place into position in the system and secured by one assembler. Beside improvements in fan efficiency and reductions in radiated noise, the housing of the present invention therefore can also provide savings in assembly costs as well. Similar savings could be realized in other applications.

We claim:

1. A one piece fan housing (1) for use with an axial flow fan comprising:

an orifice portion (13) having
an inner diameter ($D_i$) and
an interior wall (14),
said wall having a surface in form like the surface produced by rotating a planar line about a coplanar axis of generation ($A_g$) that is coincident with the axis of rotation ($A_r$) of said fan,
said planar line having a segment that when rotated produces the contour of said wall at an air inlet end with
said line segment being a quarter of an ellipse (E) whose minor axis ($A_m$) is from two to 20 hundredths (0.02 to 0.2) of said inner diameter and whose major axis ($A_M$) is parallel to said axis of generation and is one to three times the length of said minor axis;

a motor mount portion (11) centered in said orifice portion and adapted to receive an electric motor (50,50') having a rotor shaft (51) so that the axis of rotation of said rotor shaft is coincident with said interior wall surface axis of generation; and a motor support and fan stator portion (12) joined to and extending radially from said motor mount portion to join said interior wall of said orifice portion.

2. The fan housing of claim 1 in which said motor mount portion further functions as an end cap of said electric motor.

3. The fan housing of claim 1 in which said motor mount portion has means for receiving and positioning an end cap of said electric motor.

4. The fan housing of claim 1 further comprising means for mounting said fan housing in position to move air from one desired location to another desired location.

5. The fan housing of claim 1 in which said fan housing is a metal casting.

6. The fan housing of claim 1 in which
the length of said minor axis is one tenth of said inner diameter and
the length of said major axis is three times said minor axis.

* * * * *